US005261595A

United States Patent [19]

Nanno et al.

[11] Patent Number: 5,261,595

[45] Date of Patent: Nov. 16, 1993

[54] COLLAPSIBLE REFILL CONTAINER FOR GRANULAR PRODUCTS ADAPTED TO BE INSERTED INTO AN OUTER BOX-TYPE PACKAGE

[75] Inventors: Yukio Nanno, Osaka; Masaho Hayashi, Koganei, both of Japan

[73] Assignees: The Procter & Gamble Company, Cincinnati, Ohio; Dai Nippon Printing Co., Ltd., Tokyo, Japan

[21] Appl. No.: 927,766

[22] Filed: Aug. 10, 1992

[30] Foreign Application Priority Data

Aug. 12, 1991 [JP] Japan ..... 3-63669[U]

[51] Int. Cl.[5] ..... B65D 5/36; B65D 5/54

[52] U.S. Cl. ..... 229/235; 229/117.01

[58] Field of Search ..... 229/117.01, 117.07, 229/132, 235, 238, 239, 241, 242

[56] References Cited

U.S. PATENT DOCUMENTS

| | | | |
|---|---|---|---|
| Re. 26,185 | 4/1967 | Henry | 229/51 |
| 2,155,636 | 4/1939 | Bensel | 229/117.01 |
| 2,584,336 | 2/1952 | Eisenhardt et al. | 229/239 |
| 2,603,409 | 7/1952 | Crary | 229/117.01 |
| 3,140,809 | 7/1964 | Hickin et al. | 229/37 |
| 3,239,129 | 3/1966 | Schilling et al. | 229/51 |
| 3,268,150 | 8/1966 | Kuchenbecker et al. | 229/235 |
| 3,342,398 | 9/1967 | Keith | 229/235 |
| 3,366,308 | 1/1968 | Phillips, Jr. | 229/41 |
| 3,411,694 | 11/1968 | Silver | 229/132 |
| 3,438,563 | 4/1969 | Collura et al. | 229/239 |
| 3,561,667 | 2/1971 | Saltman | 229/132 |
| 3,593,911 | 7/1971 | Prellston | 229/45 |
| 3,625,410 | 12/1971 | Hirschey | 229/117.01 |
| 3,910,482 | 10/1975 | Bamburg et al. | 229/235 |
| 4,102,457 | 7/1978 | Meyers | 206/611 |
| 4,289,239 | 9/1981 | Meyers | 206/625 |
| 4,380,289 | 4/1983 | Bigelow | 229/235 |
| 4,402,452 | 9/1983 | Kupersmit | 229/117.01 |
| 4,621,736 | 11/1986 | Roccaforte | 229/239 |
| 4,679,694 | 7/1987 | Donohie et al. | 206/611 |
| 4,688,677 | 8/1987 | Roccaforte | 206/624 |
| 4,732,658 | 2/1988 | Steel | 229/238 |
| 4,986,420 | 1/1991 | Gunn et al. | 206/607 |

FOREIGN PATENT DOCUMENTS

| | | |
|---|---|---|
| 38-7388 | 3/1963 | Japan . |
| 38-26588 | 3/1963 | Japan . |
| 44-29592 | 12/1969 | Japan . |
| 53-106324 | 8/1978 | Japan . |
| 53-106325 | 8/1978 | Japan . |
| 54-44027 | 12/1979 | Japan . |
| 56-43717 | 4/1981 | Japan . |
| 56-48949 | 5/1981 | Japan . |
| 56-166221 | 12/1981 | Japan . |
| 57-13418 | 1/1982 | Japan . |
| 57-15181 | 3/1982 | Japan . |
| 57-58013 | 4/1982 | Japan . |
| 57-117315 | 7/1982 | Japan . |
| 61-137516 | 8/1986 | Japan . |
| 61-186512 | 11/1986 | Japan . |
| 62-31014 | 2/1987 | Japan . |
| 62-90308 | 6/1987 | Japan . |
| 63-57212 | 4/1988 | Japan . |
| 63-94112 | 6/1988 | Japan . |
| 1-100721 | 7/1989 | Japan . |

*Primary Examiner*—Gary E. Elkins

*Attorney, Agent, or Firm*—Dean L. Garner; E. Kelly Linman

[57] ABSTRACT

A refill container for housing granular products that is adapted to be inserted into a box-type outer package. The refill container is designed so that it is easily collapsible after its use. The container comprises an enclosure formed from opposing top and bottom walls, opposing side walls and opposing front and back walls. The container is sealed so as to prevent the flow of granular products through the enclosure prior to its opening. Lastly the container of the present invention includes a tear strip extending along the front, back and side walls. The tear strip is such that it will extend above the outer box-type package when the refill container is inserted therein.

8 Claims, 4 Drawing Sheets

COLLAPSIBLE REFILL CONTAINER FOR GRANULAR PRODUCTS ADAPTED TO BE INSERTED INTO AN OUTER BOX-TYPE PACKAGE

FIELD OF THE INVENTION

The present invention relates to refill containers for granular products. The present invention has further relation to such refill containers that are adapted to be inserted into a box-type outer package. The present invention has even further relation to such containers that are readily collapsible after use for convenient disposal thereof.

BACKGROUND OF THE INVENTION

Many products are provided to consumers in granular form which includes any form that has physical characteristics similar to granular materials such as powders. Among the list of granular consumer products are many laundry detergents and dishwashing detergents. Granular detergents are generally used in relatively large volumes. Consequently, large volumes of these products are consumed each year. Due to the vast quantity of consumer products sold in granular form there is a great demand for packages to house these products.

An example of a box-type outer package suitable for packaging granular materials is described in U.S. Pat. No. 4,986,420 issued to Gunn et al . on Jan. 22, 1991 the disclosure of which is hereby incorporated herein by reference. The Gunn et al. reference discloses a box-type package having a handle that is designed for housing granular or similar products. The package includes a liner that is adapted to prevent the flow of granular content out of the package. The package described in Gunn et al . is currently being used as a disposable package in that after the granular material that is housed in the package is used up, the package is subsequently thrown away.

Recently, however, in order to save natural resources there has been a desire to reduce the amount of packaging for such products. Because packages such as those described above in the Gunn et al . reference are relatively sturdy and are able to withstand the rigors of transportation from the manufacturer to the consumer and are able to hold up through extended periods of time, there has been the desire to design a refill container adapted to be inserted into such packages that can be readily collapsed for easy disposal and reduction of solid waste volume.

It has been known in the art to package granular materials in a plastic bag and thereafter pour the granular product into a box-type package. However, this type of refill container often causes the consumer to spill granular product when pouring. It has also been known to package the granular products in a plastic bag which is designed to be inserted into the box-type outer package. However, with these bags it is usually necessary to open the bag before inserting it into the outer package. Furthermore, while the use of a plastic bag readily reduces the volume of waste and therefore reduces solid waste volume, materials such as plastic are not as readily recyclable as other materials such as paperboard.

There has therefore been a desire to design a refill container for the box-type granular packages described above in which the refill container can be opened after insertion into the box-type outer package. There has also been a desire to make such a refill container out of fibrous paperboard which is more readily recyclable.

It is therefore an object of the present invention to provide a refill container for granular products that is adapted to be inserted into a box-type outer package wherein the refill container can be opened after insertion into the box-type outer package.

It is another object of the present invention to make such a package out of fibrous paperboard material so that the refill package is more readily recyclable.

It is another object of the present invention to provide such a package that can be easily and readily collapsed after its use so as facilitate easy disposal and reduce solid waste volume.

It is a further object of the present invention to provide such a package that is hermetically sealed.

SUMMARY OF THE INVENTION

In accordance with the present invention there is provided a refill container for housing granular products that is readily collapsible after its use. The container is adapted to be inserted into a box-type outer package. The package comprises an open top, a closed bottom and two pairs of opposing panels thereby defining a receptacle for receiving the refill container.

The container of the present invention comprises an enclosure for housing the granular products. The enclosure comprises opposing top and bottom walls, opposing side walls and opposing front and back walls. The container is sealed in such a way so as to prevent the flow of granular products through the enclosure prior to opening. Each of the side walls has a first, second and third line of weakness disposed thereon. The first and second lines of weakness are adjacent the bottom wall. The first line begins adjacent the front wall and the second line begins adjacent the back wall. The first and second lines extend along each side wall towards the top wall and meet in an apex located on the side wall intermediate the top and bottom walls. The third line of weakness disposed along each of the side walls begins adjacent the apexes and extends towards a point adjacent the top wall.

The container of the present invention further includes an additional line of weakness extending from a point adjacent one of the apexes to a point adjacent the other apex. The additional line connects these two points adjacent the apexes by extending along a portion of the side walls and at least one of the front and the back walls. Lastly the container of the present invention includes a tear strip extending along the front, back and side walls. The tear strip is adjacent the top wall so as to extend above the two pairs of opposing panels on the box-type outer package when the container is inserted into the outer package.

BRIEF DESCRIPTION OF THE DRAWINGS

While the specification concludes with claims which particularly point out and distinctly claim the subject matter forming the present invention it is believed the invention will be better understood from the following description of the preferred embodiment taken in conjunction with the accompanying drawings in which like reference numerals identify identical elements and wherein:

DETAILED DESCRIPTION OF THE INVENTION

Figure 1:
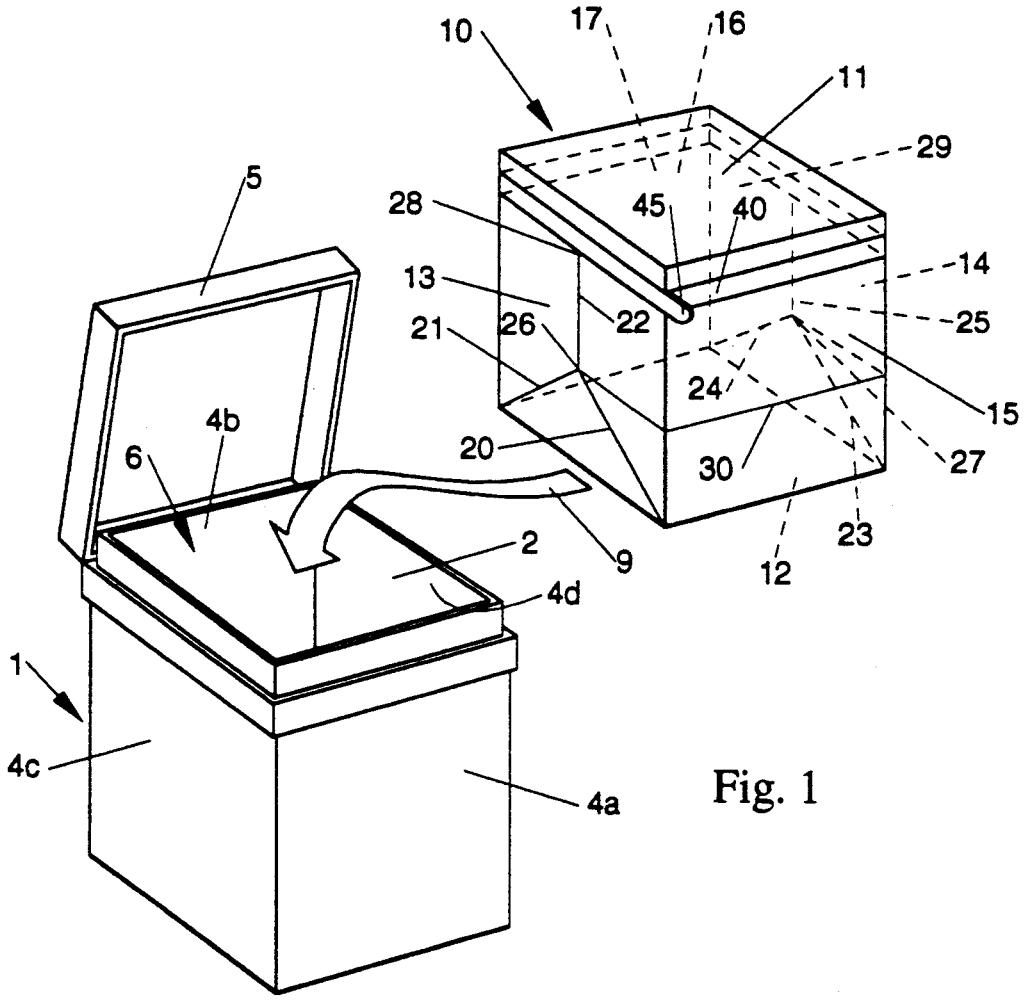
FIG. 1 is a perspective view of the refill container and the box-type outer package.

Referring to the drawings in detail wherein like numerals indicate the same element throughout the view there is shown in FIG. 1 a refill container 10 for housing granular products. The container 10 is adapted to be inserted into a box-type outer package 1. The box-type outer package 1 comprises an open top 2, a closed bottom 3 (not shown) and two pairs of opposing panels: opposing panels 4*a* and 4*b* and opposing panels 4*c* and 4*d*. The two pairs of opposing panels define a receptacle 6 for receiving the refill container 10. Package 1 may have originally contained a granular product in receptacle 6, however, as shown in FIG. 1, receptacle 6 is empty and is adapted to receive container 10. The box-type outer package may additionally include a hinged lid 2 for sealing the package when not in use. Furthermore, the box-type outer package can be a more permanent type of package made from plastic or the like.

Container 10 comprises opposing top and bottom walls 11 and 12, opposing side walls 13 and 14, and opposing front and back walls 15 and 16. All of these walls are connected together so as to define an enclosure 17 for housing the granular products. The container is sealed in such a way so as to prevent the flow of granular products out of the enclosure prior to opening so as not to lose any granular product and create a mess.

In a preferred embodiment the refill container 10 is made from paperboard. A suitable type of paperboard is what is referred to in the art as clay coated newsprint. It is preferred that the paperboard given a barrier coating to make the container moisture impervious. Various suitable barrier coatings known in art are commercially available. In another embodiment the multi-ply paperboard can be laminated with a suitable material, such as with various thermoplastics so as to hermetically seal the package. Introduction of moisture into the container is undesirable as it may cause lumping and caking of the granular products inside.

As seen from FIG. 1 it is preferred that the container 10 be made from a single blank 10*a* of paperboard material. Blank 10*a* has glue flap 19 that is designed to be wrapped around and adhered to side wall 14. After which flaps 11*a*, 11*b*, 11*c*, and 11*d* are folded together and glued to form top wall 11, and flaps 12*a*, 12*b*, 12*c*, and 12*d* are folded together and glued to form top wall 12, thereby forming container 10. When forming top wall 11 and bottom wall 12 it is desired that the minor flaps 11*a*,11*c* and 12*a*,12*c* be folded first and then major flaps 11*b*,11*d* and 12*b*,12*d* be folded over them. Any suitable glue or adhesive can be used to adhere the various flaps to each other.

Container 10 further comprises a tear strip 40 extending along the front, back and side walls. Tear strip 40 may take any number forms. In a preferred embodiment the tear strip comprises a strip of thermoplastic adhered along the front wall 15, back wall 16 and side walls 13 and 14. In another embodiment tear strip 40 comprises a pair of score lines extending around the package. In a preferred embodiment tear strip 40 includes pull tab 45 projecting outwardly from package 10. Pull tab 45 aids the consumer in removing tear strip 40.

Figure 2:
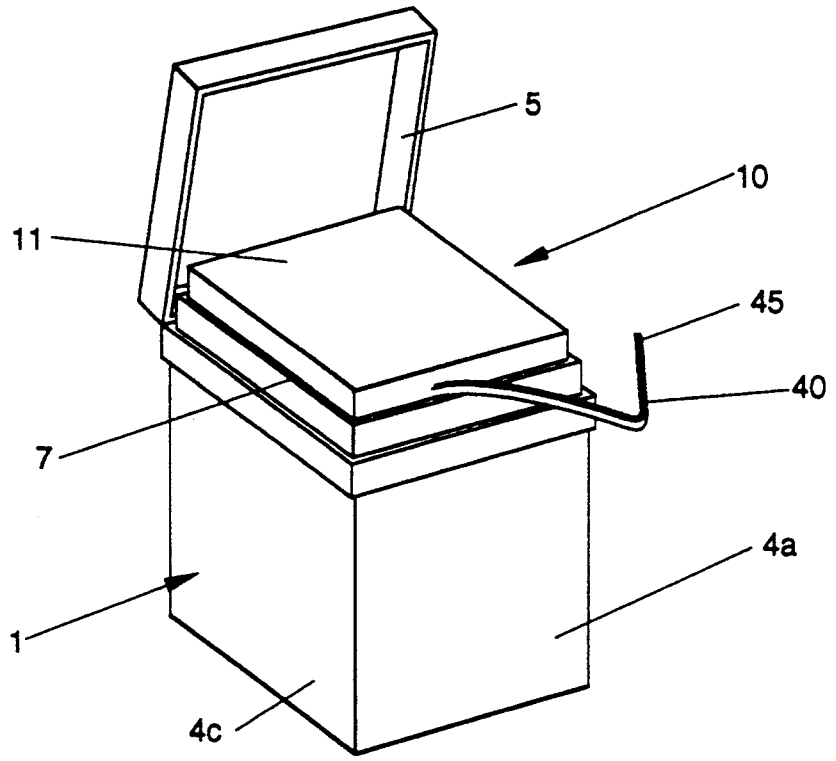
FIG. 2 is a perspective view with the refill container inside the box-type outer package and with the tear strip 40 partially removed.

As seen from FIG. 2 after the container 10 is inserted into package 1, pull tab 45 is pulled so as to remove tear strip 40. The tear strip 40 is adjacent the top wall 11 of container 10 so as to extend above the two pairs of opposing panels 4*a*,4*b* and 4*c*,4*d* of package 1 when the container is inserted into the outer package as is shown in FIG. 2. Top edge 2 of package 1 thereafter aids in removing tear strip 40 by guiding it along its path. After the tear strip 40 is completely removed from container 10, that portion of container 10 above tear strip 40 is discarded and the consumer can access the granular product. In order to prevent spillage of granular product it is desired that the container 10 be filled with product up to the point where tear strip 40 begins. If product in container 10 extends above tear strip 40, when tear strip 40 is removed product will spill from container 10 causing a mess.

Each of the side walls 13 and 14 has three lines of weakness disposed thereon which, as discussed below, helps the container 10 to readily collapse after its use. As used herein a line of weakness can refer to a fold line, a crease line, a score line, a hinge line or any other line of weakness used in the art. Side wall 13 has a first line of weakness 20, second line of weakness 21 and third line of weakness 22 disposed thereon. The first and second lines of weakness 20 and 21 are adjacent bottom wall 16. The first line of weakness 20 begins adjacent front wall 15, whereas the second line 21 begins adjacent back wall 16. Both lines 20 and 21 extend along side wall 13 towards the top wall 11 where they meet at apex 26 intermediate the top wall 11 and bottom wall 12. A third line of weakness 22 is disposed on side wall 13 and begins adjacent the apex 26 and extends towards a point 28 adjacent the top wall 11. In a preferred embodiment point 28 is where the bottom of tear strip 40 is located.

Similarly, side wall 14 has a first line of weakness 23, second line of weakness 24 and third line of weakness 25 disposed thereon. The first and second lines of weakness 23 and 24 are adjacent bottom wall 16. The first line of weakness 23 begins adjacent front wall 15 whereas the second line 24 begins adjacent back wall 16. Both lines 23 and 24 extend along side wall 14 towards the top wall 11 where they meet at apex 27 intermediate the top wall 11 and bottom wall 12. The third line of weakness 25 is disposed on side wall 14 begins adjacent the apex 27 and extends towards a point 29 adjacent the top wall 11.

Container 10 further includes an additional line of weakness 30 which extends from apex 26,or a point adjacent thereto, to apex 27, or a point adjacent thereto. As shown in the Figure, this additional line 30 extends along a portion of each side wall 13 and 14 and along the entire front wall 15. However it could just as easily extend along back wall 16. In one embodiment line 30 could circumscribe the package and extend along the entire lengths of both side walls 13 and 14, and both the front wall 15 and back wall 16.

Figure 3:
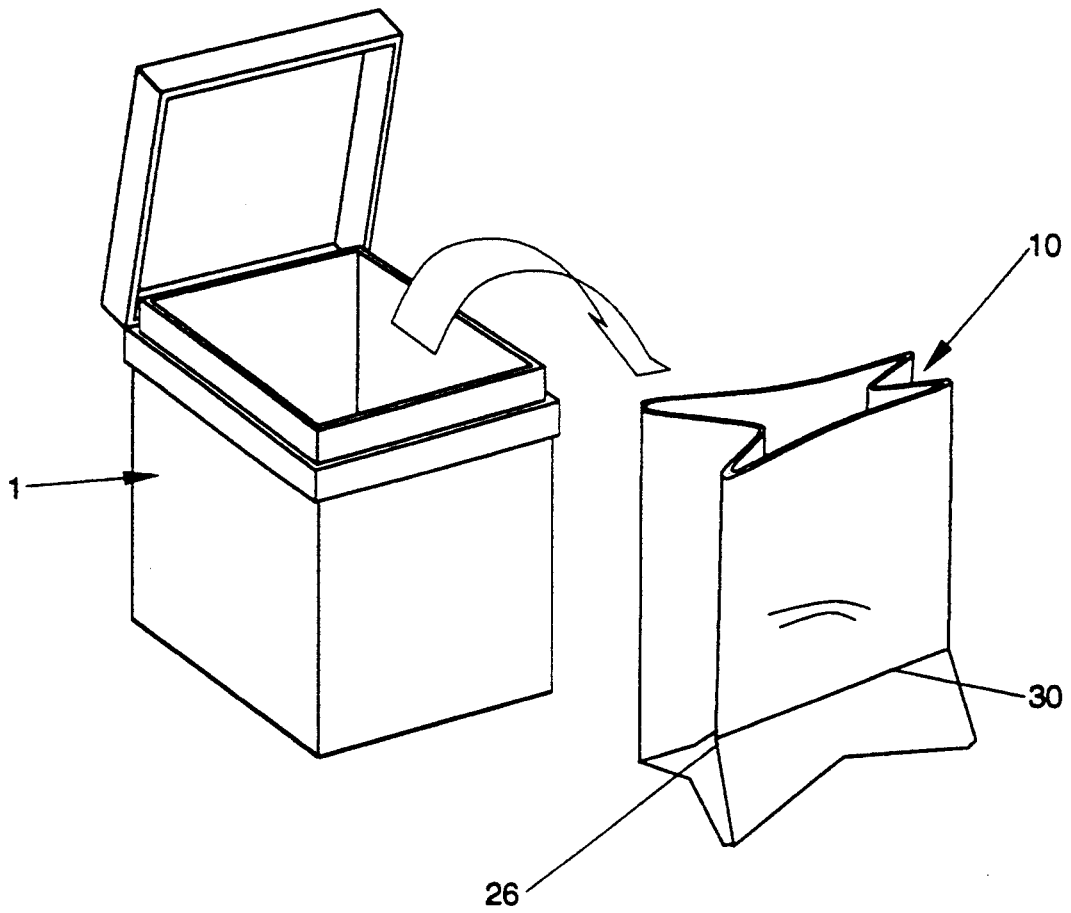
FIG. 3 is a similar view to FIG. 1 illustrating how the box-type refill is collapsed after its use.
Figure 4:
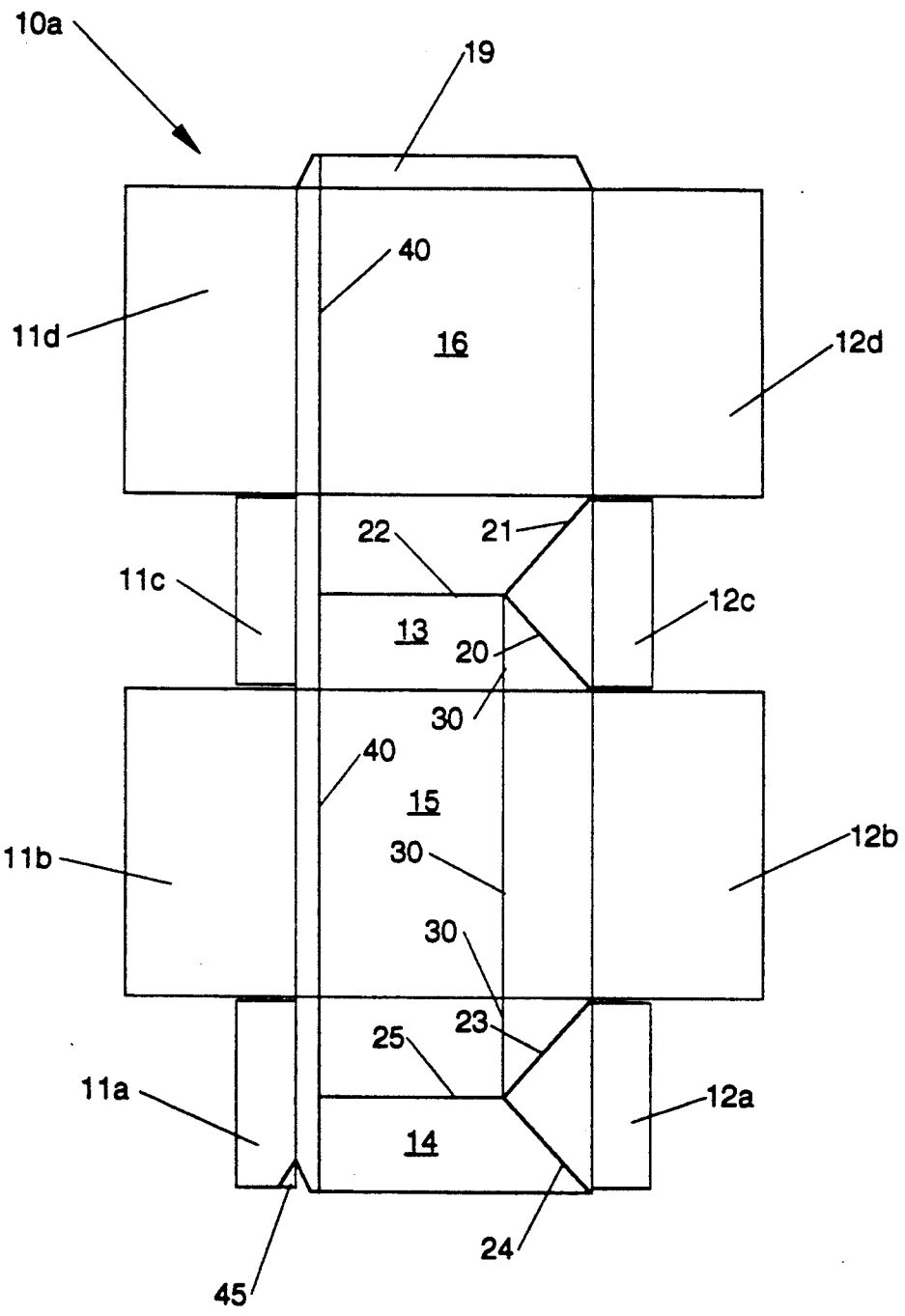
FIG. 4 is a plan view of the blank used to make the container of the present invention.

After the granular product in the container 10 is used up the container 10 is removed from package 1, as shown in FIG. 3, and thereafter discarded. The lines of weakness, mentioned above, help the consumer to easily collapse the container so that it takes up less volume in the trash. By pressing the two apexes 26 and 27 inwardly with both hands and folding the bottom wall 12 upwardly along the additional line of weakness 30, the container 10 begins to collapse much like a common paper grocery bag, and begins to look as it does in FIG. 3.

While particular embodiments of the present invention have been shown and described modification may be made to the container without departing from the teachings of the present invention. Accordingly, the present invention comprises all the embodiments within the scope of the appended claims.

What is claimed is:

1. A refill container filled with granular products, said container being readily collapsible when empty, said container adapted to be inserted into a reusable outer package, said outer package comprising an open top, a closed bottom and two pairs of opposing panels thereby defining a receptacle for receiving said refill container, said container comprising:

(a) an enclosure for housing said granular products, said enclosure comprising opposing top and bottom walls, opposing side walls, and opposing front and back walls, said container being sealed so as to prevent flow of said granular products out of said enclosure prior to opening;

(b) each of said side walls having a first, second and third line of weakness disposed thereon, said first and second lines being adjacent said bottom wall, said first line beginning adjacent said front wall and said second line beginning adjacent said back wall, said first and second lines extending towards said top wall and meeting at an apex intermediate said top and said bottom wall, said third line of weakness disposed along each of said side walls beginning adjacent said apexes and extending towards a point adjacent said top wall;

(c) said container further including an additional line of weakness extending from a point adjacent one of said apexes to a point adjacent said other apex, said additional line connecting said two points adjacent said apexes by extending along a portion of said side walls and at least one of said front wall and said back wall; and (d) a tear strip extending along said front, back and side walls, said container being filled with said granular product in such a way that said granular product does not extend above said tear strip when said container is inserted into said outer package, said tear strip being adjacent said top wall so that when said container is inserted into said outer package, said tear strip extends above said two pairs of opposing panels on said outer package, whereby after said container is inserted into said outer package said tear strip can be removed, thereby opening said container while substantially preventing said granular product from spilling.

2. The refill container according to claim 1 wherein said additional line of weakness extends along said front wall, said back wall and said side walls, thereby circumscribing said container.

3. The refill container according to claim 1 wherein said container is made from paperboard.

4. The refill container according to claim 3 wherein said paperboard has a barrier coating so as to make said container moisture impervious.

5. The refill container according to claim 1 wherein said container is moisture impervious.

6. The refill container according to claim 1 wherein said container is hermetically sealed.

7. The refill container according to claim 1 wherein said lines of weakness are fold lines.

8. The refill container according to claim 1 wherein said tear strip is a strip of flexible plastic adhered to the inside of said container along said front, back and side walls.

* * * * *